US011548686B1

(12) United States Patent
Kier

(10) Patent No.: US 11,548,686 B1
(45) Date of Patent: Jan. 10, 2023

(54) FUEL CAN WITH WATER-SEPARATING MEMBER

(71) Applicant: Patrick Kier, Cromwell, CT (US)

(72) Inventor: Patrick Kier, Cromwell, CT (US)

( * ) Notice: Subject to any disclaimer, the term of this patent is extended or adjusted under 35 U.S.C. 154(b) by 0 days.

(21) Appl. No.: 17/480,251

(22) Filed: Sep. 21, 2021

(51) Int. Cl.
*B65D 25/04* (2006.01)
*B65D 25/40* (2006.01)
*B65D 1/20* (2006.01)

(52) U.S. Cl.
CPC ..... *B65D 25/04* (2013.01); *B65D 1/20* (2013.01); *B65D 25/40* (2013.01)

(58) Field of Classification Search
CPC ..... B65D 25/04; B65D 1/20; B65D 25/40; B01D 17/0211; B01D 17/0214; B01D 21/02
See application file for complete search history.

(56) References Cited

U.S. PATENT DOCUMENTS 352,195 A 11/1886 Krag
1,116,903 A * 11/1914 McClintock ..... B01D 17/0211 210/182
4,084,937 A 4/1978 Beach
4,595,030 A 6/1986 Yazak
4,994,186 A 2/1991 Hays
D372,871 S 8/1996 Thiermann
5,868,946 A 2/1999 Nguyen
7,959,044 B1 * 6/2011 Christian ..... B65D 51/1611 222/468
8,356,618 B1 1/2013 Werner
8,590,493 B1 11/2013 Torgerud

FOREIGN PATENT DOCUMENTS

GB 190923388 A * 8/1910 ..... B65D 1/0276
WO 2019008543 1/2019

* cited by examiner

*Primary Examiner* — Donnell A Long
(74) *Attorney, Agent, or Firm* — Kyle A. Fletcher, Esq.

(57) ABSTRACT

The fuel can with water-separating member comprises a fuel can and a water-separating member. The fuel can may be a container for a liquid fuel. The water-separating member may be a non-planar, internal divider that creates a fuel chamber above the water-separating member and a water chamber below the water-separating member. Water may separate from the liquid fuel because the liquid fuel and the water are immiscible. The liquid fuel and the water may separate into a fuel layer on top and a water layer under the fuel layer. The water layer may lie entirely within the water chamber beneath the water-separating member such that the water is trapped behind the water-separating member when the fuel can is tilted to pour the liquid fuel.

18 Claims, 5 Drawing Sheets

FUEL CAN WITH WATER-SEPARATING MEMBER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of fuel containers, more specifically, a fuel can with water-separating member.

SUMMARY OF INVENTION

The fuel can with water-separating member comprises a fuel can and a water-separating member. The fuel can may be a container for a liquid fuel. The water-separating member may be a non-planar, internal divider that creates a fuel chamber above the water-separating member and a water chamber below the water-separating member. Water may separate from the liquid fuel because the liquid fuel and the water are immiscible. As non-limiting examples, the liquid fuel may be gasoline, diesel fuel, or kerosene and the liquid fuel may contain the water because of condensation within the fuel can, exposure to rain, or simply because the liquid fuel is hygroscopic and absorbed the water prior to being poured into the fuel can. The liquid fuel and the water may separate into a fuel layer on top and a water layer under the fuel layer. The water layer may lie entirely within the water chamber beneath the water-separating member such that the water is trapped behind the water-separating member when the fuel can is tilted to pour the liquid fuel.

An object of the invention is to provide a fuel can for transporting, storing, and/or dispensing a liquid fuel.

Another object of the invention is to provide a water-separating member within the fuel can.

A further object of the invention is to divide the interior of the fuel can into a fuel chamber above the water-separating member and a water chamber below the water-separating member such that when water separates out of the fuel the water drops into the water chamber and the fuel floats up into the fuel chamber.

Yet another object of the invention is to trap the water under the water-separating member when pouring the fuel such that only the fuel is poured from the fuel can.

These together with additional objects, features and advantages of the fuel can with water-separating member will be readily apparent to those of ordinary skill in the art upon reading the following detailed description of the presently preferred, but nonetheless illustrative, embodiments when taken in conjunction with the accompanying drawings.

In this respect, before explaining the current embodiments of the fuel can with water-separating member in detail, it is to be understood that the fuel can with water-separating member is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the fuel can with water-separating member.

It is therefore important that the claims be regarded as including such equivalent construction insofar as they do not depart from the spirit and scope of the fuel can with water-separating member. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
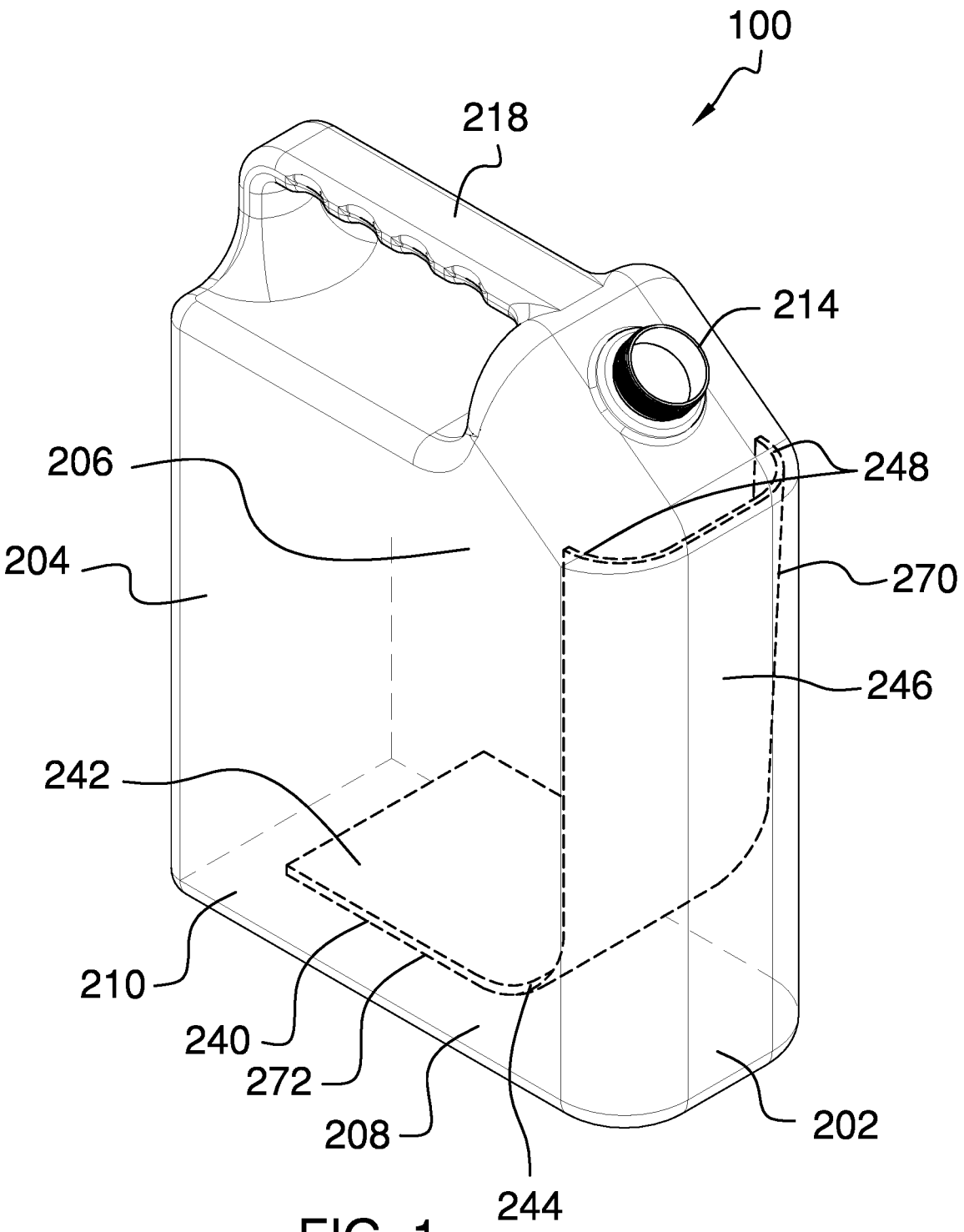
FIG. 1 is an isometric view of an embodiment of the disclosure.
Figure 2:
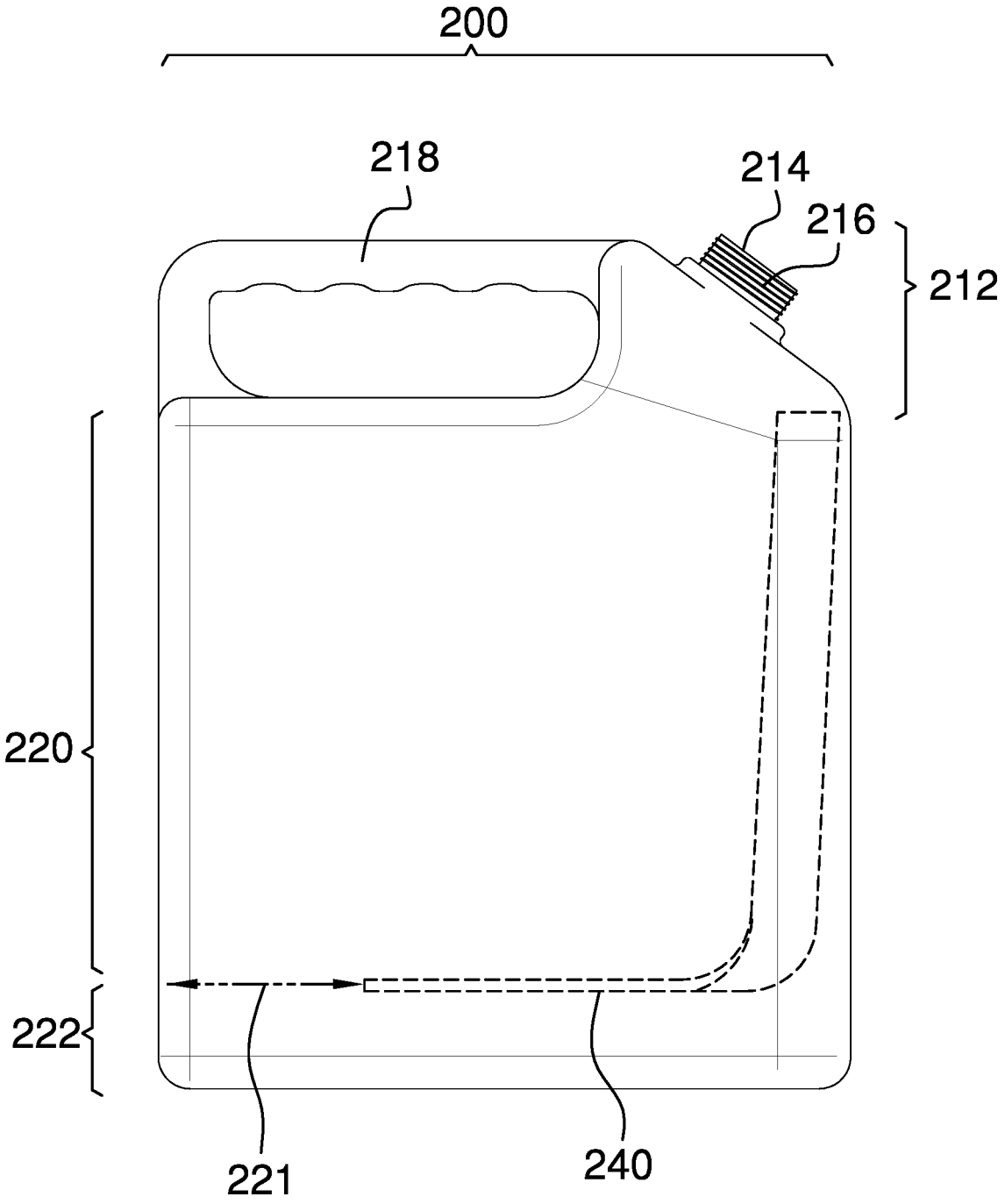
FIG. 2 is a side view of an embodiment of the disclosure.
Figure 3:
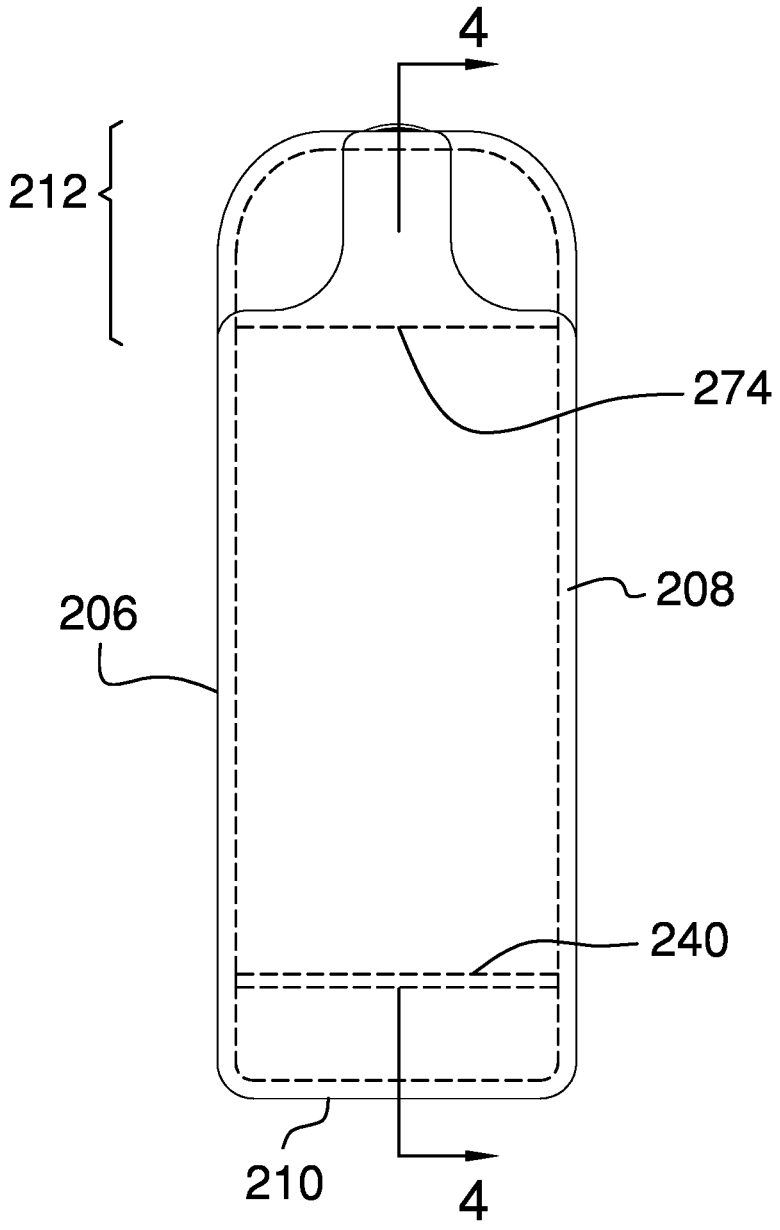
FIG. 3 is a rear view of an embodiment of the disclosure.
Figure 4:
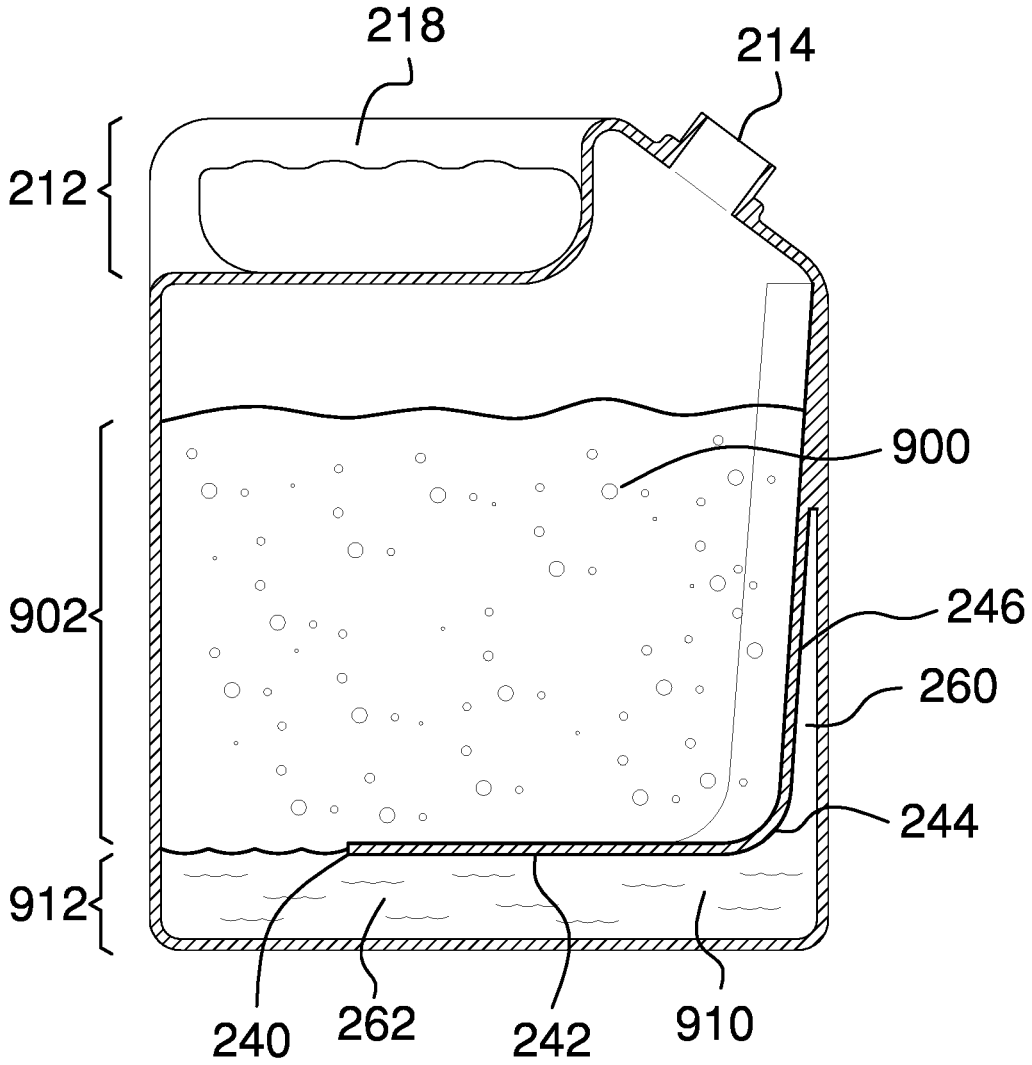
FIG. 4 is a cross-sectional view of an embodiment of the disclosure across 4-4 as shown in FIG. 3.
Figure 5:
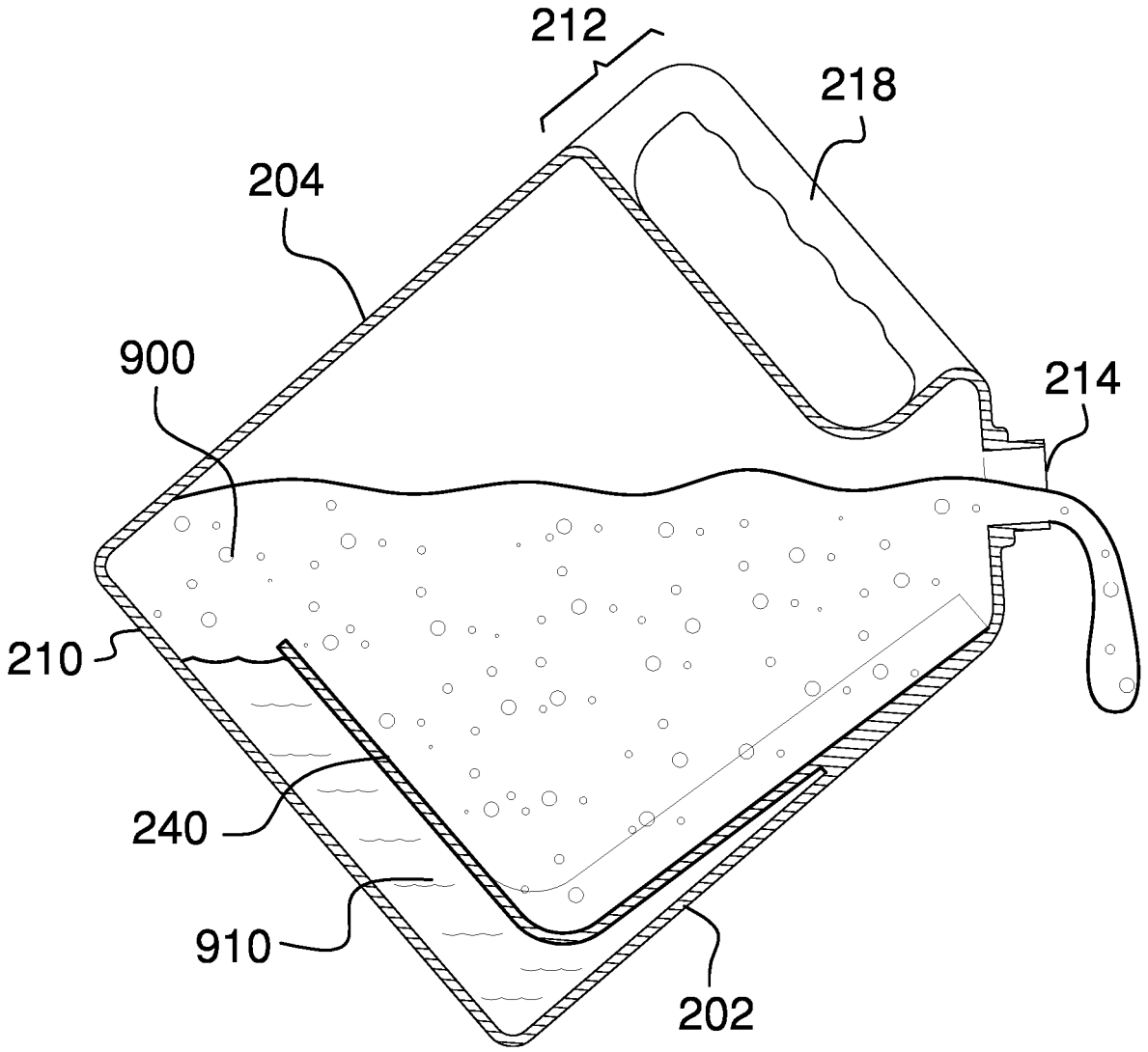
FIG. 5 is a cross-sectional in-use view of an embodiment of the disclosure.

Detailed reference will now be made to a first potential embodiment of the disclosure, which is illustrated in FIGS. 1 through 5.

The fuel can with water-separating member 100 (hereinafter invention) comprises a fuel can 200 and a water-separating member 240. The fuel can 200 may be a container for a liquid fuel 900. The water-separating member 240 may be a non-planar, internal divider that creates a fuel chamber 220 above the water-separating member 240 and a water chamber 222 below the water-separating member 240. Water 910 may separate from the liquid fuel 900 because the liquid fuel 900 and the water 910 are immiscible. As non-limiting examples, the liquid fuel 900 may be gasoline, diesel fuel, or kerosene and the liquid fuel 900 may contain the water 910 because of condensation within the fuel can 200, exposure to rain, or simply because the liquid fuel 900 is hygroscopic and absorbed the water 910 prior to being poured into the fuel can 200. The liquid fuel 900 and the water 910 may separate into a fuel layer 902 on top and a water layer 912 under the fuel layer 902. The water layer 912 may lie entirely within the water chamber 222 beneath the water-separating member 240 such that the water 910 is trapped behind the water-separating member 240 when the fuel can 200 is tilted to pour the liquid fuel 900.

The fuel can 200 may be a watertight container for transporting, storing, and/or dispensing the liquid fuel 900. In a preferred embodiment, the fuel can 200 may be made of molded plastic. In some embodiments, the fuel can 200 may be sized to hold a specific amount of the liquid fuel 900. As non-limiting examples, the fuel can 200 may have a capacity of 1.0 gallon, 2.5 gallons, or 5.0 gallons.

The fuel can 200 may comprise a front wall 202, a rear wall 204, a left side wall 206, a right side wall 208, a bottom wall 210, and a top wall 212. The left edge of the front wall 202 may be coupled to the front edge of the left side wall 206. The right edge of the front wall 202 may be coupled to the front edge of the right side wall 208. The top edge of the front wall 202 may be coupled to the front edge of the top wall 212. The bottom edge of the front wall 202 may be coupled to the front edge of the bottom wall 210. The left edge of the rear wall 204 may be coupled to the rear edge of the left side wall 206. The right edge of the rear wall 204 may be coupled to the rear edge of the right side wall 208. The top edge of the rear wall 204 may be coupled to the rear edge of the top wall 212. The bottom edge of the rear wall 204 may be coupled to the rear edge of the bottom wall 210. The top edge of the left side wall 206 may be coupled to the left edge of the top wall 212. The bottom edge of the left side wall 206 may be coupled to the left edge of the bottom wall 210. The top edge of the right side wall 208 may be coupled to the right edge of the top wall 212. The bottom edge of the right side wall 208 may be coupled to the right edge of the bottom wall 210. The fuel can 200 may rest on the bottom wall 210 when not in use.

The liquid fuel 900 may be placed into the fuel can 200 through an aperture in a pouring spout 214 located on the top wall 212. The pouring spout 214 may comprise exterior threads 216. The exterior threads 216 may be operable to couple a cap and/or an extension spout to the fuel can 200.

The fuel can 200 may be lifted using a handle 218 located on the top wall 212 and the fuel can 200 may be tilted forward towards the pouring spout 214 until the liquid fuel 900 flows out of the pouring spout 214 to dispense the liquid fuel 900.

The water-separating member 240 may be an L-shaped divider comprising a lower portion 242, a vertical bend 244, and an upper portion 246. The lower portion 242 may be horizontally oriented. The lower portion 242 may be elevated above the bottom wall 210 such that a horizontal space 262 is formed between the bottom wall 210 and the lower portion 242. The upper portion 246 may be vertically oriented with a tilt towards the front wall 202 such that a vertical space 260 is formed between the front wall 202 and the upper portion 246. The vertical bend 244 may comprise a continuous transition between the lower portion 242 and the upper portion 246. The horizontal space 262 and the vertical space 260 may define the water chamber 222. The remainder of the interior volume of the fuel can 200 excluding the water chamber 222 may define the fuel chamber 220.

The water-separating member 240 may extend laterally from the left side wall 206 to the right side wall 208. The left side of the lower portion 242, the left side of the vertical bend 244, and the left side of the upper portion 246 may be coupled to the left side wall 206 by a first joint 270. The right side of the lower portion 242, the right side of the vertical bend 244, and the right side of the upper portion 246 may be coupled to the left side wall 206 by a second joint 272.

The top of the upper portion 246 of the water-separating member 240 may be coupled to the front wall 202 by a third joint 274. The upper portion 246 may comprise one or more horizontal bends 248 to conform the top of the upper portion 246 to the contour of the front wall 202, the left side wall 206, and the right side wall 208. The first joint 270, the second joint 272, and the third joint 274 may each comprise a watertight joint that prevents the flow of the liquid fuel 900 and/or the water 910 between the fuel chamber 220 and the water chamber 222.

The water 910 may sink to the bottom of the fuel can 200 because the water 910 is denser than the liquid fuel 900. A chamber gap 224 located between the rear wall 204 and the rear of the lower portion 242 of the water-separating member 240 may permit the water 910 to flow from the fuel chamber 220 into the water chamber 222.

The water 910 within the fuel can 200 may separate from the liquid fuel 900 as the fuel can 200 rests. The water 910 may sink to occupy a layer beneath the liquid fuel 900 due to the difference in density between the water 910 and the liquid fuel 900. The water 910 may pass through the chamber gap 224 into the water chamber 222 such that all liquid above the water-separating member 240 is the liquid fuel 900. When the fuel can 200 is tilted forward to pour the liquid fuel 900, the water 910 may flow into the vertical space 260 of the water chamber 222 and the chamber gap 224 may pivot to an elevated position which prevents the water 910 from flowing back into the fuel chamber 220. The water 910 may be trapped within the water chamber 222 and may be prevented from pouring out of the fuel can 200 via the pouring spout 214.

The water 910 trapped in the water chamber 222 may be purged from the fuel can 200 after the liquid fuel 900 is consumed by tilting the fuel can 200 backwards and rotating the fuel can 200 by 180 degrees until the water 910 exits through the pouring spout 214. As the fuel can 200 is rotated backwards the water 910 in the water chamber 222 may flow along the rear wall 204, through the chamber gap 224, along the top wall 212, and finally out of the pouring spout 214. Note that a small amount of the liquid fuel 900 may be present on top of the water 910 before purging the water 910. Since the amount of the water 910 in the liquid fuel 900 cannot be predicted in advance it may be necessary to sacrifice a small amount of the liquid fuel 900 that enters the water chamber 222 to assure that none of the water 910 is poured from the fuel can 200 with the liquid fuel 900.

In use, the fuel can 200 may be filled with the liquid fuel 900 by pouring or pumping the liquid fuel 900 into the fuel can 200 via the pouring spout 214. The cap may be placed on the pouring spout 214 to seal the fuel can 200. To dispense the liquid fuel 900, the cap may be removed from the pouring spout 214, the extension spout may be coupled to the pouring spout 214, and the fuel can 200 may be tilted forward until the liquid fuel 900 pours from the fuel can 200. As the fuel can 200 is tilted forward, the water 910 that has separated from the liquid fuel 900 may be trapped behind the water-separating member 240 such that the water 910 may not exit from the fuel can 200. The water 910 that is trapped in the fuel can 200 may be purged once the liquid fuel 900 has been used by rotating the fuel can 200 backwards by 180 degrees and capturing the water 910 and any remaining fuel in a basin for proper disposal.

DEFINITIONS

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used in this disclosure, the word "exterior" may be used as a relational term that implies that an object is not located or contained within the boundary of a structure or a space.

As used herein, "handle" may refer to an object by which a tool, object, or door is held or manipulated with the hand.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, the word "interior" may be used as a relational term that implies that an object is located or contained within the boundary of a structure or a space.

As used in this disclosure, the word "lateral" may refer to the sides of an object or movement towards a side. Lateral directions are generally perpendicular to longitudinal directions. "Laterally" may refer to movement in a lateral direction.

As used in this disclosure, "vertical" may refer to a direction that is parallel to the local force of gravity. Unless specifically noted in this disclosure, the vertical direction is always perpendicular to horizontal.

As used herein, the word "watertight" may refer to a barrier that is impermeable to water.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A fuel can with water-separating member comprising:
a fuel can and a water-separating member;
wherein the fuel can is a container for a liquid fuel;
wherein the water-separating member is a non-planar, internal divider that creates a fuel chamber above the water-separating member and a water chamber below the water-separating member;
wherein the liquid fuel and water separate into a fuel layer on top and a water layer under the fuel layer;
wherein the water layer lies entirely within the water chamber beneath the water-separating member such that the water is trapped behind the water-separating member when the fuel can is tilted to pour the liquid fuel;
wherein the water-separating member is an L-shaped divider comprising a lower portion, a vertical bend, and an upper portion;
wherein the upper portion is vertically oriented with a tilt towards a front wall such that a vertical space is formed between the front wall and the upper portion;
wherein the vertical bend comprises a continuous transition between the lower portion and the upper portion.

2. The fuel can with water-separating member according to claim 1
wherein the fuel can is a watertight container for transporting, storing, and/or dispensing the liquid fuel.

3. The fuel can with water-separating member according to claim 2
wherein the fuel can is made of molded plastic.

4. The fuel can with water-separating member according to claim 2
wherein the fuel can comprises the front wall, a rear wall, a left side wall, a right side wall, a bottom wall, and a top wall;
wherein the left edge of the front wall is coupled to the front edge of the left side wall;
wherein the right edge of the front wall is coupled to the front edge of the right side wall;
wherein the top edge of the front wall is coupled to the front edge of the top wall;
wherein the bottom edge of the front wall is coupled to the front edge of the bottom wall;
wherein the left edge of the rear wall is coupled to the rear edge of the left side wall;
wherein the right edge of the rear wall is coupled to the rear edge of the right side wall;
wherein the top edge of the rear wall is coupled to the rear edge of the top wall;
wherein the bottom edge of the rear wall is coupled to the rear edge of the bottom wall;
wherein the top edge of the left side wall is coupled to the left edge of the top wall;
wherein the bottom edge of the left side wall is coupled to the left edge of the bottom wall;
wherein the top edge of the right side wall is coupled to the right edge of the top wall;
wherein the bottom edge of the right side wall is coupled to the right edge of the bottom wall;
wherein the fuel can rests on the bottom wall when not in use.

5. The fuel can with water-separating member according to claim 4
wherein the liquid fuel is placed into the fuel can through an aperture in a pouring spout located on the top wall.

6. The fuel can with water-separating member according to claim 5 wherein the pouring spout comprises exterior threads;

wherein the exterior threads are operable to couple a cap and/or an extension spout to the fuel can.

7. The fuel can with water-separating member according to claim 6 wherein the fuel can is lifted using a handle located on the top wall and the fuel can is tilted forward towards the pouring spout until the liquid fuel flows out of the pouring spout to dispense the liquid fuel.

8. The fuel can with water-separating member according to claim 7 wherein the lower portion is horizontally oriented;

wherein the lower portion is elevated above the bottom wall such that a horizontal space is formed between the bottom wall and the lower portion.

9. The fuel can with water-separating member according to claim 8 wherein the horizontal space and the vertical space define the water chamber.

10. The fuel can with water-separating member according to claim 9 wherein the interior volume of the fuel can excluding the water chamber defines the fuel chamber.

11. The fuel can with water-separating member according to claim 10 wherein the water-separating member extends laterally from the left side wall to the right side wall;

wherein the left side of the lower portion, the left side of the vertical bend, and the left side of the upper portion are coupled to the left side wall by a first joint.

12. The fuel can with water-separating member according to claim 11 wherein the right side of the lower portion, the right side of the vertical bend, and the right side of the upper portion are coupled to the left side wall by a second joint.

13. The fuel can with water-separating member according to claim 12 wherein the top of the upper portion of the water-separating member is coupled to the front wall by a third joint.

14. The fuel can with water-separating member according to claim 13 wherein the upper portion comprises one or more horizontal bends to conform the top of the upper portion to the contour of the front wall, the left side wall, and the right side wall.

15. The fuel can with water-separating member according to claim 13 wherein the first joint, the second joint, and the third joint each comprise a watertight joint that prevents the flow of the liquid fuel and/or the water between the fuel chamber and the water chamber.

16. The fuel can with water-separating member according to claim 15 wherein the water sinks to the bottom of the fuel can because the water is denser than the liquid fuel;

wherein a chamber gap located between the rear wall and the rear of the lower portion of the water-separating member permit the water to flow from the fuel chamber into the water chamber.

17. The fuel can with water-separating member according to claim 16 wherein the water within the fuel can separates from the liquid fuel as the fuel can rests;

wherein the water sinks to occupy a layer beneath the liquid fuel;

wherein the water passes through the chamber gap into the water chamber such that all liquid above the water-separating member is the liquid fuel;

wherein when the fuel can is tilted forward to pour the liquid fuel, the water flows into the vertical space of the water chamber and the chamber gap pivots to an elevated position which prevents the water from flowing back into the fuel chamber;

wherein the water is trapped within the water chamber and is prevented from pouring out of the fuel can via the pouring spout.

18. The fuel can with water-separating member according to claim 17 wherein the water trapped in the water chamber is purged from the fuel can after the liquid fuel is consumed by tilting the fuel can backwards and rotating the fuel can by 180 degrees until the water exits through the pouring spout;

wherein as the fuel can is rotated backwards the water in the water chamber flows along the rear wall, through the chamber gap, along the top wall, and out of the pouring spout.

* * * * *